United States Patent [19]

Oderbolz et al.

[11] Patent Number: 5,074,340

[45] Date of Patent: Dec. 24, 1991

[54] YARN SELECTOR UNIT FOR A WEFT FEEDER

[75] Inventors: Fredy Oderbolz, Tann-Ruti; Robert Szonyi, Gommiswald; Walter Stark, Galgenen, all of Switzerland

[73] Assignee: Sulzer Brothers Limited, Winterthur, Switzerland

[21] Appl. No.: 527,046

[22] Filed: May 22, 1990

[30] Foreign Application Priority Data

Jul. 5, 1989 [CH] Switzerland ..... 02498/89

[51] Int. Cl.[5] ..... D03D 47/38

[52] U.S. Cl. ..... 139/453

[58] Field of Search ..... 139/453, 455; 66/127

[56] References Cited

U.S. PATENT DOCUMENTS 4,298,034 11/1981 Viscardi ..... 139/453

4,438,791 3/1984 Oesterle et al. ..... 139/453

4,852,618 8/1989 Zollinger et al. ..... 139/453

*Primary Examiner*—Andrew M. Falik

*Attorney, Agent, or Firm*—Kenyon & Kenyon

[57] ABSTRACT

A yarn selector unit of a loom has a number of feeders associated one each with a weft yarn. Each feeder is drivable by a tongue drivable selectively via a lever by way of a slide. The tongue and therefore the feeder are moved into a different position when it is required to present a weft yarn to a gripper or withdraw a weft yarn. The tongue is moved transversely by two actuators disposed opposite one another into a predetermined top or bottom position relative to the actuators by the action therefor. Positioning of the tongue relative to a tongue-moving slide is therefore always clearly defined so that misactuation of the yarn selector unit cannot occur.

7 Claims, 3 Drawing Sheets

YARN SELECTOR UNIT FOR A WEFT FEEDER

This invention relates to a yarn selector unit. More particularly, this invention relates to a yarn selector unit for a loom.

Heretofore, various types of yarn selector units have been known for the picking of a weft yarn into a shed of warp yarns in a loom. For example, European Patent Application 0293558 describes a yarn selector unit having a plurality of feeders associated one with each weft yarn and with each feeder being drivable by a tongue. Each tongue is, in turn, drivable in a lengthwise manner by means of a lever while also being displaceable transversely of its length by an actuator system so as to be disposed in the zone of influence of the lever when the transverse movement of the tongue produced by the actuator system is performed in a particular direction. In this respect, the tongue is engaged by the continuously reciprocating lever when the actuator system pivots the tongue through a reduced angle towards the lever. As described, this is achieved by means of a rocker having one arm in engagement with the tongue while the other arm can be attracted by a magnet. A spring acting on the other arm ensures that the rocker is not in contact with the magnet when the same is inoperative. In this case, the other arm of the rocker raises the tongue so that the lever can engage in a recess in the tongue and move the tongue and, therefore, the weft yarn feeder into a position in which the weft yarn can be engaged by the loom picking element. Correct actuation of the tongue in accordance with a preset color program depends upon whether the magnet can overcome the spring force or whether, with the magnet inoperative, the spring can produce a return movement of the rocker.

However, a problem which arises with actuators systems of this type is the assurance of identical force relationships when springs are used over prolonged periods of time since the material of the spring may become fatigued so that the spring force diminishes. The result, in this case, would be misoperation of the yarn selector unit.

Accordingly, it is an object of the invention to provide a yarn selector unit for a loom in which the correct weft yarn can be selected without the use of springs.

Briefly, the invention provides a yarn selector unit for a loom which is comprised of at least one feeder, a reciprocally mounted tongue articulated to the feeder, a pair of selectively actuatable actuators for moving the tongue transversely of the length thereof and an oscillating lever for engaging and moving the tongue.

The feeder, as is known, is movable between a first position for picking of a weft yarn into a shed of warp yarns and a second position to prevent picking of the weft yarn into the shed of warp yarns. Likewise, the tongue is articulated to the feeder for pivoting the feeder between these positions.

The first actuator is disposed for moving the tongue in a first direction transversely of the length thereof to a first position while the second actuator is disposed opposite the first actuator for moving the tongue in a second direction opposite the first direction to a second position.

The lever engages with the tongue when the tongue is in the first position thereof in order to effect the pivoting of the feeder between the positions thereof. Otherwise, the lever is disengaged from the tongue when the tongue is in the second position thereof.

In accordance with the invention, each actuator is in the form of an electromagnet.

In another embodiment, the first actuator may be an electromagnet while the second actuator is an electromagnet having a permanent magnet core operative in an opposite direction to the first actuator and a call which is energized to inhibit the effect of the permanent magnet core.

The actuators are spaced apart to define a gap for passage of the tongue therethrough. In addition, the gap is sized to limit the transverse movement of the tongue toward one or the other actuator. Thus, depending upon the operative state of the actuators, the tongue can perform a reduced movement towards one or the other of the actuators.

The yarn selector unit also includes a slide which is connected to the lever for movement therewith in a rectilinear path and which has a recess therein. In this case, the tongue has a projection for engaging in the recess of the slide when the tongue is in the first position thereof and which is spaced from the recess when the tongue is in the second position thereof. That is, depending upon the position of the tongue relative to the actuators, the tongue can take up two different positions relative to the slide and which is adapted to move the tongue longitudinally. Thus, when the tongue engages in the recess in the slide, the tongue is reciprocated together with the feeder in time with slide movements.

The tongue may also have a projection for engaging in a recess of a stationary tongue guide in order to secure the tongue in a displaced position thereof. In addition, this stationary tongue guide may have a second recess spaced from the first recess to secure the tongue in a second displaced position thereof.

In a further embodiment, the slide connected to the lever has a hook and a tappet extending from one end to define a recess for slidably receiving the tongue therebetween. In this embodiment, the tongue has a projection for engagement with the hook during movement of the slide in one direction with the tongue in a first actuated position thereof. The tongue also has a step for engagement with the tappet during movement of the slide in an opposite direction with the tongue in the first actuated position thereof.

In order to select a discrete feeder for a yarn in the selector unit, a single actuator is placed on standby and the opposite actuator is rendered inoperative. Thus, a change in the tongue position in the gap between the actuators is inhibited and the tongue can be displaced by means of the slide. Active selection of one or the other actuator enables the tongue to be displaced reliably. Hence, there is no risk of misoperations in the yarn selector unit. The operating reliability of the yarn selector unit is therefore improved considerably.

These and other objects and advantages of the invention will become more apparent from the following detailed description taken in conjunction with the accompanying drawings wherein.

Figure 3A:
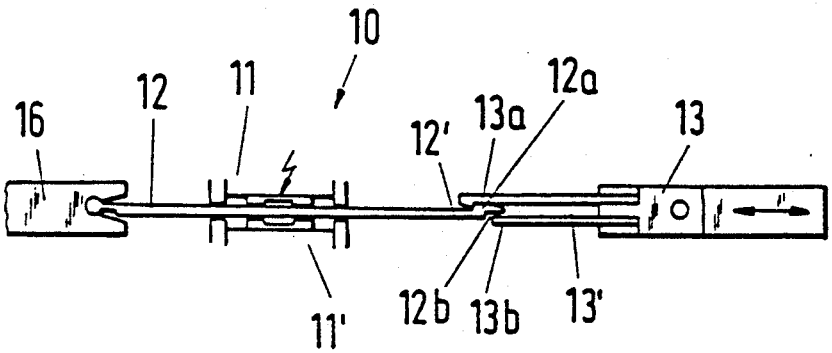
Figure 3B:
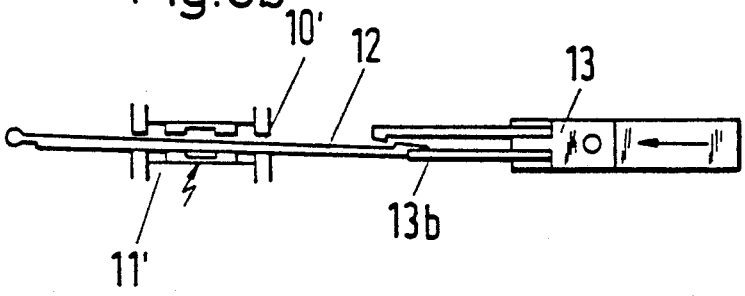
Figure 3C:
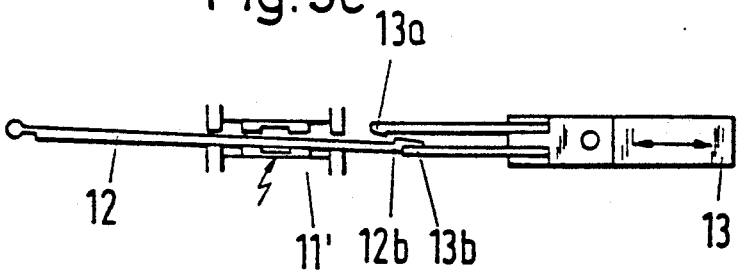
Figure 3D:
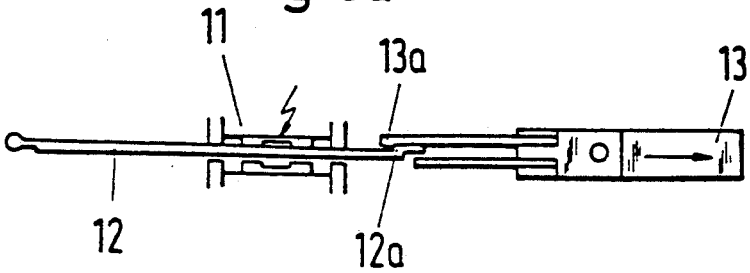

FIG. 3*a* schematically illustrates the position of a tongue and slide in a operating position for movement of the tongue in one direction;

FIG. 3*b* illustrates a view similar to FIG. 3*a* for movement of the tongue in an opposite direction;

FIG. 3*c* illustrates a view of the tongue and slide of FIG. 3*a* in a position displaced to the left; and FIG. 3*d* illustrates a position on the tongue and slide for a return movement of the tongue in accordance with the invention.

Figure 1:
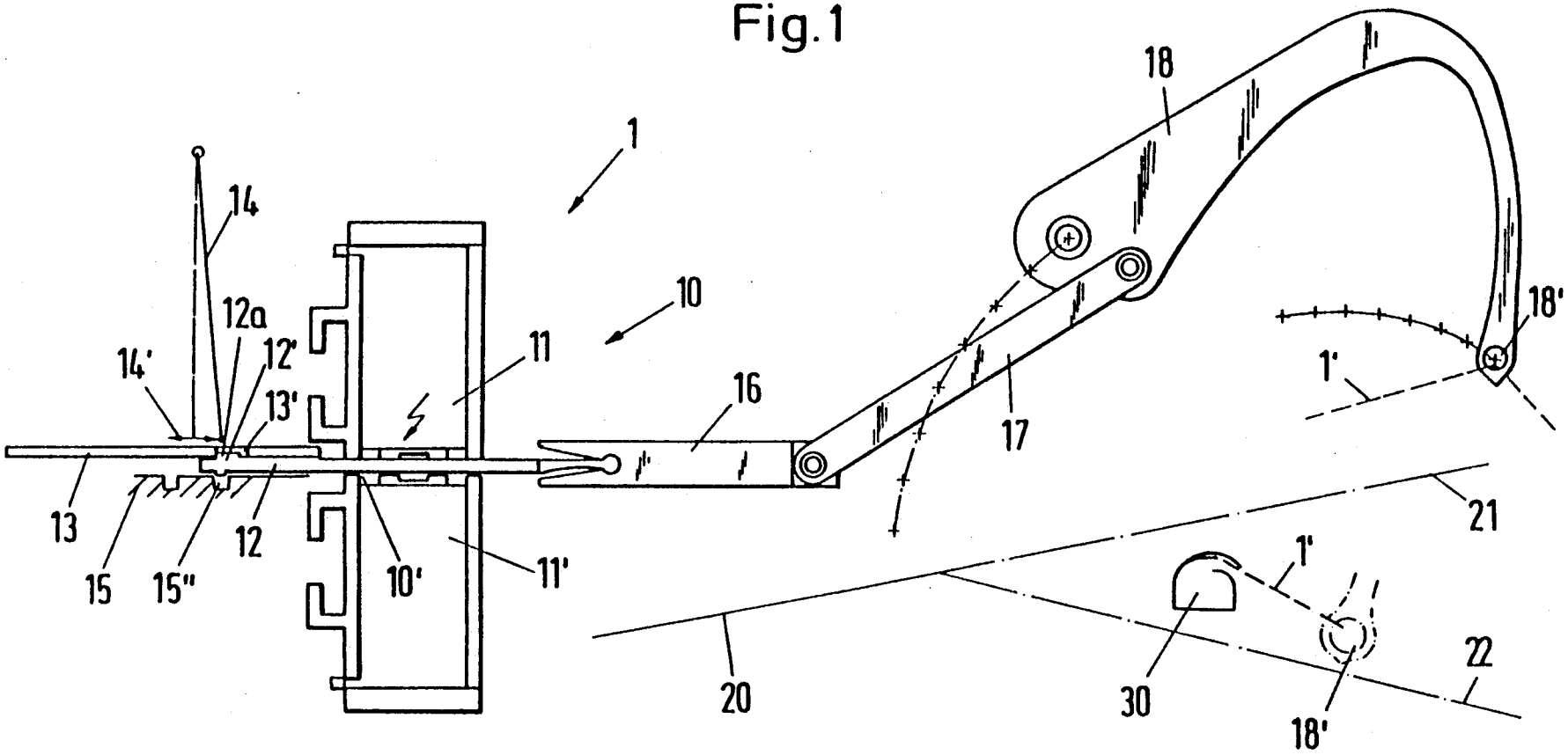
FIG. 1 illustrates an individual feeder of a yarn selector unit constructed in accordance with the invention in a raised position.

Referring to FIG. 1, the yarn selector unit 1 is disposed for use in a loom and has an actuator system 10 comprised of a pair of actuators 11, 11' each of which is embodied by an electromagnet. As illustrated, the two actuators 11, 11' are spaced apart to define a gap 10' for passage of a tongue 12 therethrough. This gap 10' is sized to limit transverse movement of the tongue 12 toward one or the other actuator, 11, 11' depending upon the operative state of the actuator system 10.

As illustrated, the yarn selector unit includes a plurality of feeders 18, each of which is movable between a first position as shown in dotted line in FIG. 1 for picking of a weft yarn 1' into a shed of warp yarns, 21, 22 for subsequent formation into a cloth 20. In addition, each feeder 18 is movable into a position as shown in solid line in FIG. 1 to prevent picking of a weft yarn 1' into the shed of warped yarns 21, 22.

As indicated, a gripper 30 is provided for picking of each weft yarn 1' within the shed of warp yarns 21, 22.

Each feeder 18 is pivotally mounted and connected by a link 17 to a thrust rod 16 which, in turn, is articulated to the tongue 12. The thrust rod 16 is guided in a rectilinear path by a suitable means (not shown).

The yarn selector unit 1 also has a slide 13 which is guided in a rectilinear path and which is drivable by an oscillating lever 14. For example, the lever !4 is pivoted by an eccentric drive (not shown) in the direction indicated by a double arrow 14'. The lever 14, can engage, for example, in a recess 13' in the slide 13 in order to drive the slide 13 positively. During weaving, the lever 14 moves from one end position to another end position.

As illustrated, the tongue end 12' remote from the thrust rod 16 has a projection 12*a* which, when the tongue 12 is closer to the top actuator 11 than to the bottom actuator 11' engages in the recess 13' in the slide 13. This is the case where the actuator 11 is ready to operate. This is indicated by the hazard sign shown on the actuator 11 in FIG. 1.

A stationary tongue guide 15 is also disposed outside the actuator system 10 and is provided with a pair of spaced apart recesses 15', 15" in which a projection 12*c* of the tongue 12 may engage in an alternating manner.

Figure 2:
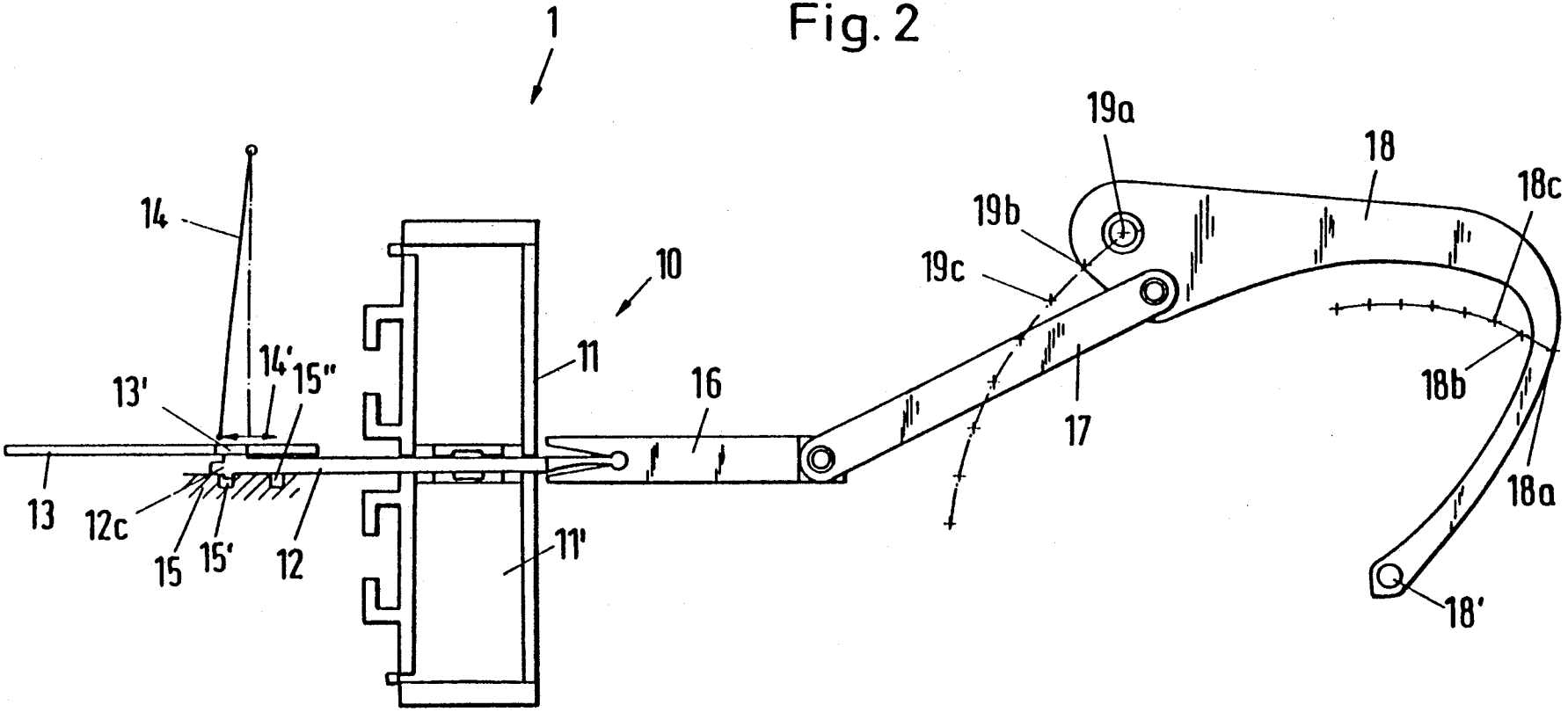
FIG. 2 illustrates the feeder in a lowered position for yarn transfer to a picking element.

When the position of a feeder 18 is not to be changed, the projection 12*c* is retained in one of the recesses 15', 15" by means of the electromagnet 11' which pulls the tongue 12 down, as indicated in FIG. 2.

In a preferred form of operation of the actuator system 10, the actuator 11 is operated during a displacement of the tongue 12 by the slide 13 and stopped when the lever 14 reaches an end position. The other actuator 11' is then energized so that after reaching its end position, the tongue 12 engages by way of the projection 12*c* in one of the recesses 15', 15" of the stationary guide 15. In the end position shown in FIG. 1 of the lever 14, slide 13, tongue 12 and feeder 18, the weft yarn 1' is retained by means of an eye 18' in a position in which the gripper 30, effective as a weft yarn picking element, cannot reach the weft yarn 1. FIG. 2 shows the other end position of the parts referred to. The chain dotted-line position of the eye 18' in FIG. 1 corresponds to the yarn position in which the weft yarn 1, is engaged during the picking movement of gripper 30.

The crosses 18*a*, 18*b*, 18*c* etc and 19*a*, 19*b*, 19*c* in FIG. 2 denote the eye centers and, respectively, the pivot axes of the various feeders 18 of a yarn selector unit. The eye centers or the pivot axes must be staggered to enable the various weft yarns 1', 1" and so on to be selected individually without hampering one another. Corresponding to the various positions of the axes 19*a*, 19*b*, 19*c*, the various links 17 of a unit 1 have different lengths whereas all the rods 16, tongues 12, slides 13 and so on are identical.

FIGS. 3*a*–3*d* show various operative positions in a yarn selector unit and a different embodiment of the tongue 12 and slide 13. In this embodiment, the tongue 12 has a projection 12*a* and a step 12*b* which are respectively engageable with a hook 13*a* and tappet 13*b* of the slide 13, according as the tongue 12 is closer to the top actuator 11 or to the bottom actuator 11'. In this construction, in contrast to the construction shown in FIGS. 1 and 2, there is no inoperative position for the tongue 12 in a recess 15' or 15". The hook 13*a* pulls the tongue end 12' to the right in FIG. 3*d* when the actuator 11 is ready to operate and the tappet 13*b* pushes the tongue end 12' to the left in FIG. 3*b* when the other actuator 11' is ready to operate. The readiness to operate of the top and bottom actuators 11, 11' must be coordinated with the timing of the change of direction of the slide, as indicated by arrows in FIGS. 3*a*–3*d*. The operation will be described hereinafter in detail.

FIG. 3*a* The top actuator 11 is in operation, the tongue end 12 is raised and cannot be engaged by the slide tappet 13*b*. The thrust rod 16 and tongue 12 therefore continue to remain in the right-hand end position when the side 13 reciprocates as indicated by a double arrow.

FIG. 3*b* The tongue 12 is to be displaced to the left, a movement which can be produced by the eye 18' (not shown) of FIG. 1 rising and pulling the tongue !2 therewith. To this end, the actuator 11, is prepared for operation so that on the next movement of the slide from right to left, the tappet 13*b* can engage the tongue step 12*b*. The tongue 12 therefore moves to the left with the slide 13 as indicated by an arrow in FIG. 3*b*.

FIG. 3*c* The bottom actuator 11, remains energized—i.e., ready to operate—so that the tongue 12 is in its bottom position and the hook 13*a* cannot engage the projection 12*a*. While the slide 13 reciprocates in the direction indicated by the double arrow in FIG. 3*c*, the tongue 12 remains in the left-hand end position and no weft yarn 1' is presented to the gripper.

FIG. 3*d* This shows the alteration in position from left to right of the tongue 12 and slide 13 when the actuator 11 has been re-energized and the hook 13*a* has engaged the projection 12*a*.

The invention thus provides a yarn selector unit which does not rely upon springs for operation. Further, the invention provides a yarn selector unit which is reliable in operation and which is capable of a long operating life.

What is claimed is:

1. A yarn selector unit for a loom comprising at least one feeder movable between a first position for picking of a weft yarn into a shed of warp yarns, and a second position to prevent picking of the weft yarn into the shed of warp yarns;

a reciprocally mounted tongue articulated to said feeder for pivoting said feeder between said positions;

a first selectively actuatable actuator for moving said tongue in a first direction transversely of the length thereof to a first position;

a second selectively actuatable actuator opposite said first actuator for moving said tongue in a second direction opposite said first direction to a second position; and an oscillating lever for engaging and moving said tongue with said tongue in said first position thereof, said lever being disengaged from said tongue with said tongue in said second position thereof.

2. A yarn selector unit as set forth in claim 1 wherein each actuator is an electromagnet.

3. A yarn selector unit as set forth in claim 2 wherein the electromagnet of said second actuator includes a first means operative in an opposite direction to said first actuator and a second means for inhibiting the effect of said first means.

4. A yarn selector unit as set forth in claim 1 wherein said actuators are spaced apart to define a gap for passage of said tongue therethrough, said gap being sized to limit transverse movement of said tongue toward each respective actuator.

5. A yarn selector unit as set forth in claim 1 which further comprises a slide connected to said lever for movement therewith in a rectilinear path and having a recess therein, and wherein said tongue has a projection for engaging in said recess with said tongue in said first position thereof and being spaced from said recess with said tongue in said second position thereof.

6. A yarn selector unit as set forth in claim 1 which further comprises a stationary tongue guide having a pair of longitudinally spaced recesses, and wherein said tongue has a projection for engaging in a respective one of said recesses to secure said tongue in a displaced position thereof.

7. A yarn selector unit as set forth in claim 1 which further comprises a slide connected to said lever for movement therewith in a rectilinear path, said slide having a hook and a tappet extending from one end to define a recess receiving said tongue therebetween, and wherein said tongue has a projection for engagement with said hook during movement of said slide in one direction with said tongue in said first position thereof, said tongue having a step for engagement with said tappet during movement of said slide in an opposite direction with said tongue in said first position thereof.

* * * * *